US006139260A

United States Patent [19]

Arbeus

[11] Patent Number: 6,139,260

[45] Date of Patent: Oct. 31, 2000

[54] PUMP HAVING A PUMP HOUSING WITH ONE OR MORE FEEDING GROOVES

[75] Inventor: Ulf Arbeus, Lidingo, Sweden

[73] Assignee: ITT Manufacturing Enterprises, Inc., Wilmington, Del.

[21] Appl. No.: 09/185,271

[22] Filed: Nov. 3, 1998

[30] Foreign Application Priority Data

Dec. 18, 1997 [SE] Sweden ..... 9704729

[51] Int. Cl.[7] ..... F04D 29/42; F04D 29/70

[52] U.S. Cl. ..... 415/121.2; 415/169.1

[58] Field of Search ..... 415/169.1, 121.1, 415/121.2; 241/46.06, 46.017

[56] References Cited

U.S. PATENT DOCUMENTS

| | | | |
|---|---|---|---|
| 3,340,812 | 9/1967 | Schlesiger | 415/121.1 |
| 3,447,475 | 6/1969 | Blum | 415/121.1 |
| 4,349,322 | 9/1982 | Stahle | 415/121.2 |
| 5,011,370 | 4/1991 | Sodergard | 415/121.1 |
| 5,707,016 | 1/1998 | Witsken | 241/46.06 |

FOREIGN PATENT DOCUMENTS

| | | | |
|---|---|---|---|
| 274809 | 1/1914 | Germany | 415/121.2 |
| 2452548 | 5/1975 | Germany | 415/121.1 |
| 408159 | 4/1934 | United Kingdom | 415/121.1 |

*Primary Examiner*—Christopher Verdier
*Attorney, Agent, or Firm*—Menotti J. Lombardi

[57] ABSTRACT

A pump of a centrifugal- or a half axial type meant for pumping liquids, mainly sewage water, the pump having a pump housing and a pump impeller. The pump impeller includes a hub provided with one or several vanes, the leading edges of which being strongly swept backwards. Feeding grooves are arranged in the surrounding pump housing in a surface opposed the vanes.

4 Claims, 2 Drawing Sheets

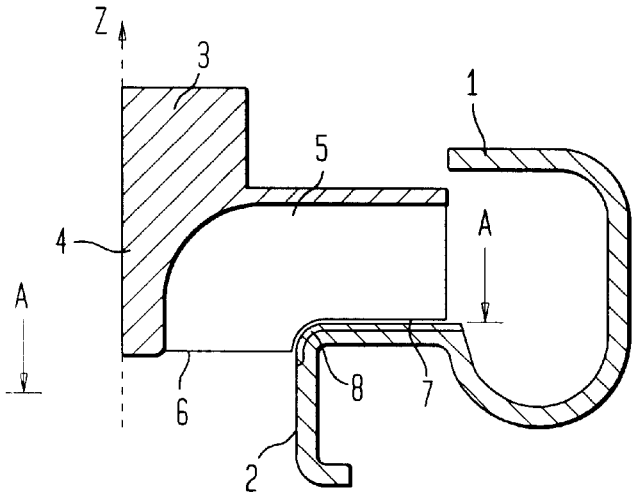
FIG. 2
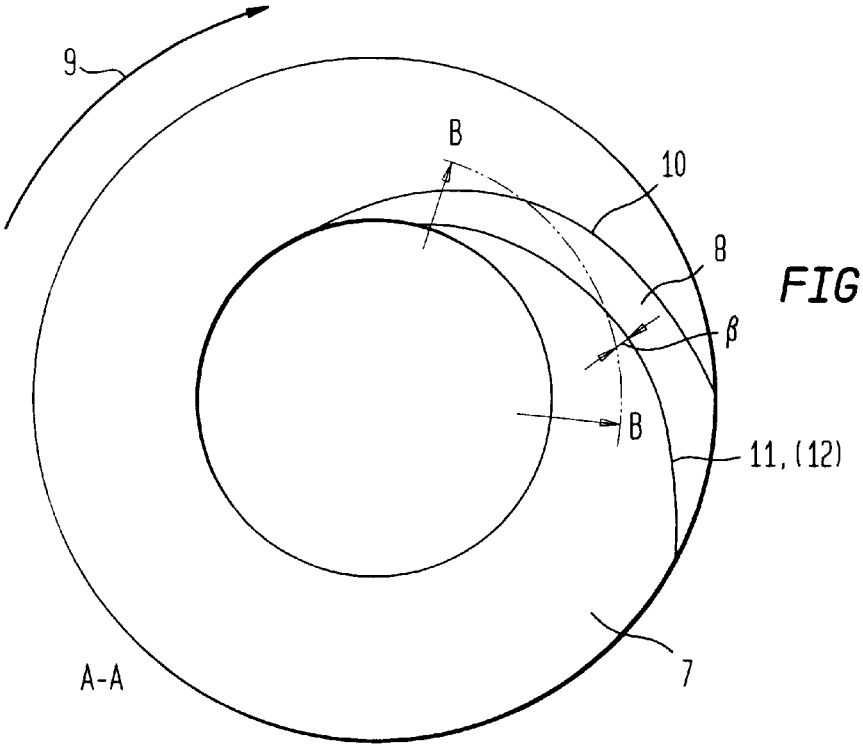
FIG. 3
FIG. 4
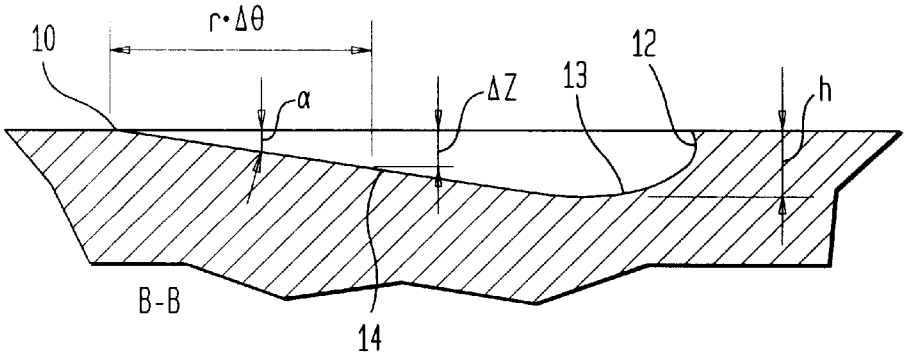

PUMP HAVING A PUMP HOUSING WITH ONE OR MORE FEEDING GROOVES

FIELD OF THE INVENTION

The invention concerns a centrifugal- or half axial pump for pumping of fluids, mainly sewage water.

BACKGROUND OF THE INVENTION

In literature there are lot of types of pumps and pump impellers for this purpose described, all however having certain disadvantages. Above all this concerns problems with clogging and low efficiency.

Sewage water contains a lot of different types of pollutants, the amount and structure of which depend on the season and type of area from which the water emanates. In cities plastic material, hygiene articles, textile, etc, are common, while industrial areas may produce wearing particles. Experience shows that the worst problems are rags and the like which stick to the leading edges of the vanes and become wound around the impeller hub. Such incidents cause frequent service intervals and a reduced efficiency.

In agriculture and pulp industry, different kinds of special pumps are used, which should manage straw, grass, leaves and other types of organic material. For this purpose the leading edges of the vanes are swept backwards in order to cause the pollutants to be fed outwards to the periphery instead of getting stuck to the edges. Different types of disintegration means are often used for cutting the material and making the flow more easy. Examples are shown in SE-435 952, SE-375 831 and U.S. Pat. No. 4,347,035.

As pollutants in sewage water are of other types more difficult to master, and as the operation times for sewage water pumps normally are much longer, the above mentioned special pumps do not fullfil the requirements when pumping sewage water, neither from a reliability nor from an efficiency point of view.

A sewage water pump quite often operates up to 12 hours a day which means that the energy consumption depends a lot on the total efficiency of the pump.

Tests have proven that it is possible to improve efficiency by up to 50 % for a sewage pump according to the invention as compared with known sewage pumps. As the life cycle cost for an electrically driven pump normally is totally dominated by the energy cost (about 80% of the life cycle cost), it is evident that such a dramatic increase will be extremely important.

In literature the designs of the pump impellers are described very generally, especially as regards to the sweep of the leading edges. An unambigous definition of said sweep does not exist.

Tests have shown that the design of the sweep angle distribution on the leading edges is very important in order to obtain the necessary self cleaning ability of the pump impeller. The nature of the pollutants also calls for different sweep angles in order to provide a good function.

Literature does not give any information about what is needed in order to obtain a gliding, transport, of pollutants outwards in a radial direction along the leading edges of the vanes What is mentioned is in general that the edges shall be obtuse-angled, swept backwards etc. See SE-435 952.

When smaller pollutantans such as grass and other organic material are pumped, relatively small angles may be sufficient in order to obtain the radial transport and also to disintigrate the pollutants in the slot between pump impeller and the surrounding housing. In practice disintigration is obtained by the particles being cut through contact with the impeller and the housing when the former rotates having a periphery velocity of 10 to 25 m/s. This cutting process is improved by the surfaces being provided with cutting devices, slots or the like.

Different sorts of notches and cutting means are described in SE-435 952 and SE-375 831. They all have in common that the vane is located behind a shoulder This means a considerable loss of efficiency as compared with an even contour which is used in high efficiency pumps for clean water.

In SE-435 952, an embodiment is shown where an axial aperture is located behind a shoulder. The theory is that pollutants shall be fed outwards to said aperture by the vanes having leading edges strongly swept backwards. This embodiment described very generally, is however not suitable to pump heavy pollutants contained in sewage water.

In SE-375 831, a solution is described using the opposite principle that pollutants are transported towards the centre, away from the slot. This fact, in combination with the previously mentioned shoulder, makes feeding into the slot impossible.

As previously mentioned, it is a condtion that the leading edges of the vanes are swept strongly backwards in order to make a transport of the pollutants outwards and into the slot at the periphery possible. If this is not obtained, serious shut downs will occur very soon. Pump impellers of this type are described in SE-9704222-0 and SE-9704223-8. When the pollutants slide outwards and reach the slot between the vane and the pump housing wall, there is however a risk that they will stick to the periphery of the leading edge and clog within the slot.

In DE-614 426 there is shown a device meant to solve such problems, without the need for the previously mentioned shoulder. The pump is a centrifugal pump having a very sharp linking from the axial inlet to the radial part of the flow channel. The periphery of the leading edge is located downstream of said linking in the radial part of the channel.

A device is further mentioned which has a solid notch in front of the leading edge with a decreasing height up to a cutting knife, followed by a spiral formed groove with a triangular cross section and sharp corners and which widens towards the periphery. In addition it is stated that the basic principle for this type of solution is that the replacable cutting means shall disintegrate the pollutants. If this should fail, for. instance if the cutting means is blunt, the consequence will be that the decreasing height of the notch will compress the pollutants to clogg where the area has its minimum, i.e. within the area of said cutting means.

The above mentioned patent thus describes a solution which, under certain conditions, may obtain a self cleaning ability, but which has got important disadvantages concerning efficiency, wear resistance and life. In addition, there are no details given about the very important conditions regarding the leading edges of the vanes and thus it has no meaning to try to apply this described device when pumping sewage water.

SUMMARY OF THE INVENTION

The invention concerns a device for pumping sewage water and which eliminates the disadvantages combined with previously known solutions.

BRIEF DESCRIPTION OF THE DRAWINGS

The invention is described more closely below with reference to the enclosed drawings.

FIG. 2 a radial cut through a schematic view of a pump according to the invention, FIG. 3 a schematic axial view towards the pump housing surface and FIG. 4 a cylindric cut through a groove in the pump housing surface.

DETAILED DESCRIPTION OF THE INVENTION

Figure 1:
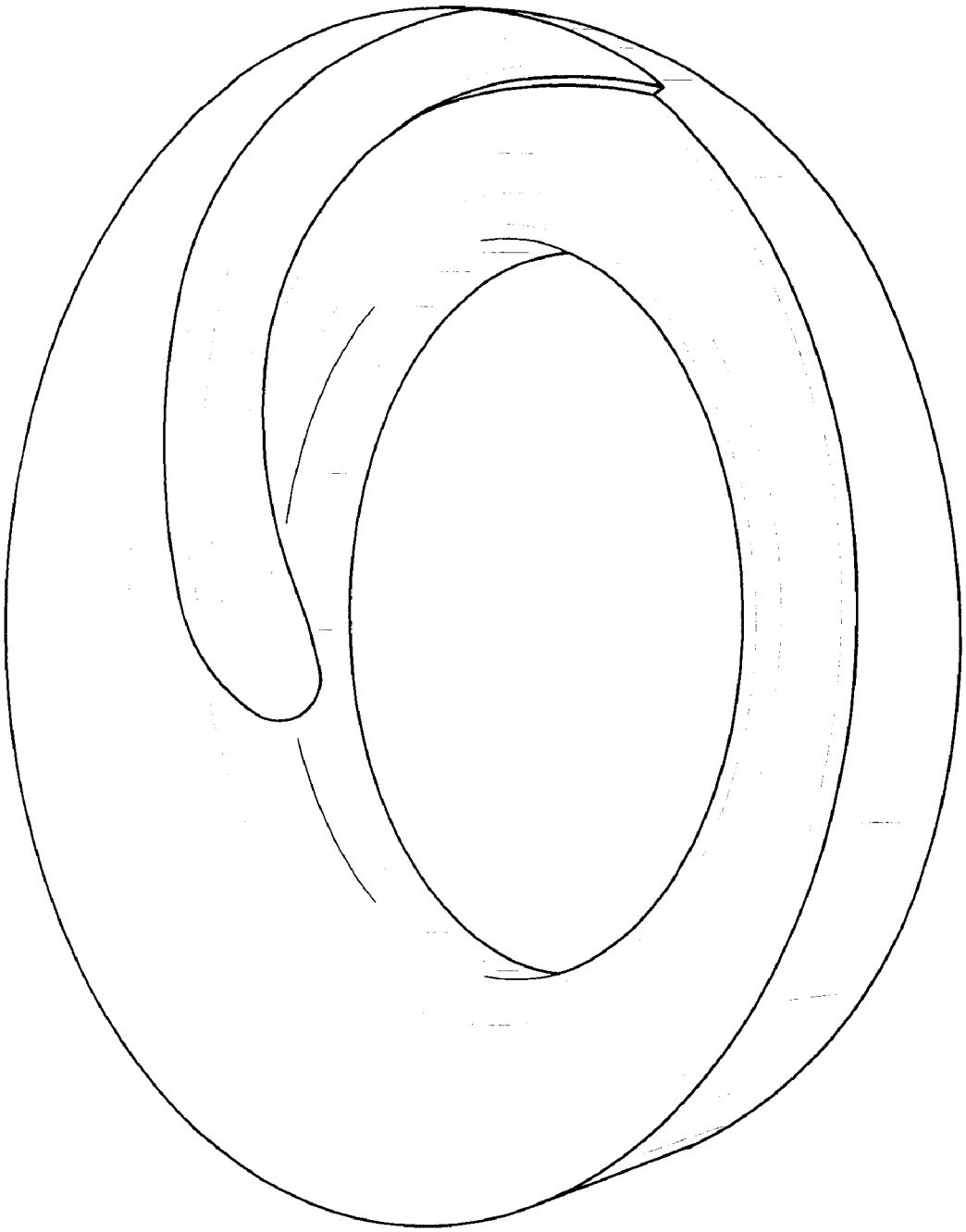
FIG. 1 shows a three dimensional view of a pump housing.

In the drawings 1 stands for a centrifugal pump housing having a cylindric inlet 2. 3 stands for a pump impeller with a cylindric hub 4 and a vane 5. 6 stands for the leading edge of the vane , 7 the pump housing wall, 8 a groove in the wall, 9 the direction of rotation and z the rotation axis. 10 and 11 stand for the edges of the groove 8, 12 a surface in the groove, 13 the bottom of the groove and h its depth.

An important principle with the invention is that the pollutants in the pumped liquid are not disintegrated by cutting means. To the contrary, a much more robust construction is used which feed the pollutants outwards to the periphery. This means that the life of the machine is increased considerably, especially when pumping wearing particles. The design is also stable, meaning that a decrease of the wear on the pump housing wall will occur.

The invention concerns a pump having a special type of pump impeller 3 where the leading edges 6 of the vane or vanes 5 are located upstream of the pump housing, i. e. within the cylindric inlet 2 and where the leading edges lie in a plane perpendicular to the rotation axis z of said impeller.

According to the invention one or several notches or grooves 8, are provided in the wall of the pump housing and which extend over a surface 7 opposing the impeller, i e. from the essentially cylindric inlet 2 to the essentially axial pump housing surface and having a form specified below. The groove or grooves 8 cooperate with the leading edges 6 of the vane or vanes in such a way that pollutants are fed in the direction of the pump outlet.

In order to secure the feeding through the pump and to make sure of other advantages as compared with known technique, the groove 8 is given a special route and geometry.

In FIG. 4 the form of a cylindric cut through the groove is shown characterized in a smooth connection 10 to the pump housing surface 7 at the side from which the impeller passes. The opposing side 11 of the groove in the mentioned cylinder cut, is a, with relation to the pump housing wall, mainly orthogonal surface 12, which continously transforms into a mainly elliptic bottom 13, which has a characterizing transverse axis, the length of which being at least twice the depth of the groove. This rounding of the bottom is important as wearing particles will be transported from the surface 7 by secondary currents and thus the wear on said surface will be considerably reduced.

Between the smooth connection 10 to the surface 7 and the bottom 13 of the groove there is a mainly linear transition 14. The angle $\gamma$ between said transition and the surface 7 shall lie within the interval 2 to 25 degrees where $\gamma$ is defined as $$\gamma=\arctan((\Delta z/(r\cdot\Delta\theta))$$

where $\Delta z$ is the axial displacement and $r\cdot\Delta\theta$ is the tangential extention.

FIG. 3 shows the sweep angle $\beta$ of the groove 8 where $$\beta=\arctan((\sqrt{(dr\cdot dr+dz\ dz)}/(r\cdot d\theta))$$

and where dr, $d\theta$ and dz are infinitesimal displacements along the edge of the groove.

According to the invention, the sweep angle $\beta$ shall have a value between 10 and 45 degrees along its entire route in order to obtain the best result.

By help of the invention several advantages are obtained when compared with the solutions known up to now The following could be mentioned.

The need for a specific and permanent or replaceble cutting means is eliminated as the feeding function takes care of the pollutants and bring them away.

The swept groove 8 acts as a slot seal which brings about a direct efficiency increase as the leakage through the slot is reduced.

A reduction of the wear of the surface adjacent the groove is obtained as the wearing particles are brought away from this aera after having passed through the groove. In this way a good efficiency is kept also when the sewage water contains wearing particles.

A long life is obtained as wearing particles in the pumped medium cause a wear which preserves the original forms of the details. This means that a good function is kept, also after a certain wear, The device is adapted to a pump impeller having an optimal form from a performance point of view, as the route of the groove 8 transforms from an axial to a radial direction.

What is claimed is:

1. A pump of a centrifugal- or half axial type for pumping of sewage water, the pump comprising:

a pump housing having a wall including at least one feeding groove defined therein, a cylindrical inlet, and an outlet; and an impeller having a central hub, at least one vane with swept back leading edges, and an impeller shaft having an axis, the leading edges of the at least one vane being located in a plane substantially perpendicular to the impeller shaft;

the at least one feeding groove in the wall of the pump housing arranged on a surface of the wall opposite the at least one vane of the impeller, the at least one feeding groove located upstream of the area of the leading edges of the at least one vane, the at least one feeding groove routing from the inlet towards the outlet and swept in the rotation direction of the impeller, the at least one feeding groove having a first side that connects to the surface of the wall with a smooth connection, and an opposing generally orthogonally directed second side that continuously transforms into a generally elliptic bottom.

2. A pump according to claim 1, wherein the at least one feeding groove has an edge and a sweep angle $\beta$ defined between the edge of the at least one groove and an arc having the axis of the impeller as its center in each point on the at least one groove edge and a radius r, the sweep angle $\beta=\arctan((\sqrt{(dr\cdot dr+dz\cdot dz/(r\cdot d\theta))}$ and having a value between 10 and 45 degrees along its entire route, where dr, $d\theta$ and dz are infinitesimal displacements along the edge of the at least one feeding groove.

3. A pump according to claim 1, wherein the bottom of the at least one feeding groove has an axial displacement $\Delta z$ and a groove width $r\cdot\Delta\theta$, the smooth connection of the at least one feeding groove having a sloping part that forms an angle $\gamma$ with the surface of the pump housing wall, wherein $\gamma=\arctan((\Delta z/r\cdot\Delta\theta))$ and has a value between 2 and 25 degrees.

4. A pump according to claim 1, wherein the elliptic bottom of the at least one feeding groove has a transverse axis with a length of at least twice the depth of the at least one feeding groove.

* * * * *